US007704042B2

(12) United States Patent
Brueckner et al.

(10) Patent No.: US 7,704,042 B2
(45) Date of Patent: Apr. 27, 2010

(54) TURBOMACHINE, ESPECIALLY A GAS TURBINE

(75) Inventors: Gerhard Brueckner, Altomuenster (DE); Manfred Feldmann, Eichenau (DE); Bernd Kislinger, Reisgang (DE); Joachim Wulf, Munich (DE)

(73) Assignee: MTU Aero Engines GmbH, Munich (DE)

( * ) Notice: Subject to any disclaimer, the term of this patent is extended or adjusted under 35 U.S.C. 154(b) by 701 days.

(21) Appl. No.: 10/582,840

(22) PCT Filed: Nov. 27, 2004

(86) PCT No.: PCT/DE2004/002634

§ 371 (c)(1),
(2), (4) Date: Jun. 14, 2006

(87) PCT Pub. No.: WO2005/059312

PCT Pub. Date: Jun. 30, 2005

(65) Prior Publication Data

US 2007/0122270 A1 May 31, 2007

(30) Foreign Application Priority Data

Dec. 19, 2003 (DE) ..... 103 59 730

(51) Int. Cl.
*F01D 9/04* (2006.01)

(52) U.S. Cl. ..... 415/189; 415/121.3; 415/209.2; 81/176.15

(58) Field of Classification Search ..... 415/134, 415/136, 139, 189, 209.1, 209.2, 209.3, 213.1, 415/121.3; 29/889.22; 81/13, 124.4, 176.15
See application file for complete search history.

(56) References Cited

U.S. PATENT DOCUMENTS

| | | | | |
|---|---|---|---|---|
| 847,768 | A * | 3/1907 | Hartman | 81/13 |
| 1,412,965 | A * | 4/1922 | Pridemore | 81/13 |
| 2,102,897 | A * | 12/1937 | Holhut | 81/13 |
| 2,801,075 | A | 7/1957 | Broffit | |
| 2,910,269 | A | 10/1959 | Haworth et al. | |
| 2,971,333 | A | 2/1961 | Mendelsohn et al. | |

(Continued)

FOREIGN PATENT DOCUMENTS

DE 198 07 247 9/1999

(Continued)

*Primary Examiner*—Edward Look
*Assistant Examiner*—Nathaniel Wiehe
(74) *Attorney, Agent, or Firm*—W. F. Fasse; W. G. Fasse

(57) ABSTRACT

A turbomachine has a stator and a rotor, wherein the rotor has blades (21) and the stator has a housing (20) and stationary guide vanes (17), wherein the guide vanes (17) form guide vane rings (11, 12) that adjoin the housing (20) with radially outwardly positioned ends (18) and adjoin the rotor with radially inwardly positioned ends. The guide vane rings are spoke-centered with the aid of bearing journals or guide pins (24) allocated to the housing (20) and penetrating through the housing (20). The guide pins (24) extend at a slant relative to the radial direction and the axial direction of the turbomachine, wherein the ends (26) of the guide pins (24) reaching into the housing engage in forked elements (27) allocated to the radially outer ends (18) of the guide vane rings (11, 12).

18 Claims, 3 Drawing Sheets

U.S. PATENT DOCUMENTS

| | | | | | |
|---|---|---|---|---|---|
| 3,104,091 | A | | 9/1963 | Vivian | |
| 3,365,173 | A | * | 1/1968 | Lynch et al. | 415/209.3 |
| 3,841,787 | A | * | 10/1974 | Scalzo | 415/136 |
| 4,632,634 | A | | 12/1986 | Vinciguerra et al. | |
| 4,856,963 | A | * | 8/1989 | Klapproth et al. | 415/190 |
| 5,188,008 | A | * | 2/1993 | States | 81/13 |
| 5,618,161 | A | * | 4/1997 | Papageorgiou et al. | 415/190 |
| 5,775,874 | A | | 7/1998 | Boite et al. | |
| 6,139,263 | A | | 10/2000 | Klingels | |
| 6,752,591 | B2 | | 6/2004 | Hain | |
| 7,070,387 | B2 | * | 7/2006 | Crozet et al. | 415/173.1 |
| 7,234,920 | B2 | * | 6/2007 | Imbourg et al. | 415/213.1 |
| 2005/0089401 | A1 | * | 4/2005 | Phipps | 415/178 |

FOREIGN PATENT DOCUMENTS

| | | |
|---|---|---|
| DE | 100 37 837 | 3/2002 |

* cited by examiner

TURBOMACHINE, ESPECIALLY A GAS TURBINE

FIELD OF THE INVENTION

The invention relates to a turbomachine or turbo-engine, particularly a gas turbine, and further relates to a mounting device for a turbo-engine.

BACKGROUND INFORMATION

Turbo-engines, for example gas turbines, comprise a rotor and a stator, whereby the rotor comprises rotor blades that rotate with the rotor and the stator comprises a housing and guide vanes. The rotor blades of the rotor rotate relative to the stationary housing and relative to the stationary guide vanes of the stator. The guide vanes form guide vane rings and the rotor blades form rotor blade rings, whereby respectively one rotor blade ring is arranged between two guide vane rings arranged one behind the other in the throughflow direction. The guide vane rings border with a radially outwardly positioned end, particularly with an outer cover band or belt, on the housing and with a radially inwardly positioned end, particularly with an inner cover band or belt, on the rotor. The guide vane rings must be secured to the housing of the turbo-engine and spoke centered relative to the housing.

German Patent Publication DE 198 07 247 A1 discloses such a turbo-engine whereby bearing journal pins are provided for the centering and fixing of the guide vane rings. According to the German Patent Publication DE 198 07 247 A1 the bearing journal pins fixed to the housing pass through the housing of the turbo-engine and engage into bearing bushings arranged in the guide vane rings for the spoke centering of the guide vane rings. Thereby the guide pins pass through the housing of the turbo-engine in a radial direction. Thus, a longitudinal central axis of the bearing bushings extends parallel to the radial direction of the turbo-engine, whereby the corresponding bearing bushings also are oriented in the radial direction of the turbo-engine. According to German Patent Publication DE 198 07 247 A1, seal carriers are positioned between two neighboring guide vane rings, whereby the seal carriers are hooked into or suspended from the outer cover bands or belts of the guide vane rings.

SUMMARY OF THE INVENTION

Starting from the above, the problem to be solved according to the invention is to provide a new turbo-engine.

This problem is solved in that a turbo-engine mentioned above is further developed according to the invention, wherein the guide pins extend approximately perpendicularly to the housing whereby guide pin ends extending into the housing engage fork-shaped elements allocated to the radially outwardly positioned ends of the guide vane rings. The guide pins may extend approximately perpendicularly to the housing, but especially extend at a slant relative to the radial direction and relative to the axial direction of the turbo-engine.

According to an advantageous further embodiment of the invention, the guide vane rings as well as the seal carriers are spoke centered with the aid of the guide pins and/or the fork-shaped elements. Each fork-shaped element preferably limits (defines) at least two recesses or receptacle spaces, whereby the guide pins engage in a first recess and whereby projections of the seal carriers engage in a second recess. The two recesses of the fork-shaped elements are positioned next to each other in the circumferential direction.

In the sense of the present invention it is suggested that the guide pins for the spoke centering of the guide vane rings are oriented perpendicularly to the housing of the turbo-engine. Thus, the guide pins do not extend in the radial direction of the turbo-engine but rather, on the one hand, at a slant to the radial direction and, on the other hand, at a slant to the axial direction of the turbo-engine. Guide pin ends reaching into the housing thus also extend at a slant to the axial direction and to the radial direction of the turbo-engine and cooperate with the fork-shaped elements in the area of the guide vane rings. In this context the fork-shaped elements are constructed to be at least partially open in the radial direction and in the axial direction of the turbo-engine in order to make possible the engagement of the fork-shaped elements with the guide pin ends reaching into the housing.

A simpler realization of the turbine-engine housing is possible with the aid of the construction according to the invention, because radially extending guide sleeves for the bearing journal pins or for guide pins can be obviated in the housing. This feature permits a clearly simpler construction of the housing and thus reduces the production-costs of the turbo-engine.

The mounting device according to the invention is for aligning or adjusting the guide pins, and includes a plate-shaped base body and at least two recesses integrated into the plate-shaped base body, whereby for the alignment or adjustment of at least two of the guide pins, the guide pin ends reaching into the housing extend respectively into a corresponding recess of the mounting device positioned on the inside of the housing, and whereby the guide pins, the ends of which reach into the recesses of the mounting device, can be tightened by nuts positioned on the outside of the housing.

BRIEF DESCRIPTION OF THE DRAWINGS

An example embodiment of the invention, without limitation thereto, will now be described in more detail with reference to the drawing. The drawing shows.

DETAILED DESCRIPTION OF EXAMPLE EMBODIMENTS OF THE INVENTION

The present invention will now be described in greater detail with reference to FIGS. 1 to 3. Before referring to the details of the preferred example embodiments, it should be mentioned that the present invention is suitable generally for all turbo-engines or turbo-engines with a rotor and a stator. The invention is particularly suitable for use in a compressor or a turbine of a gas turbine particularly an aircraft engine. With regard to thermodynamic and dimensional considerations the present invention is preferably used in connection with low pressure turbines of medium size to large gas turbines. Thus, FIG. 1 shows a portion of an axial longitudinal section through a low pressure turbine.

Figure 1:
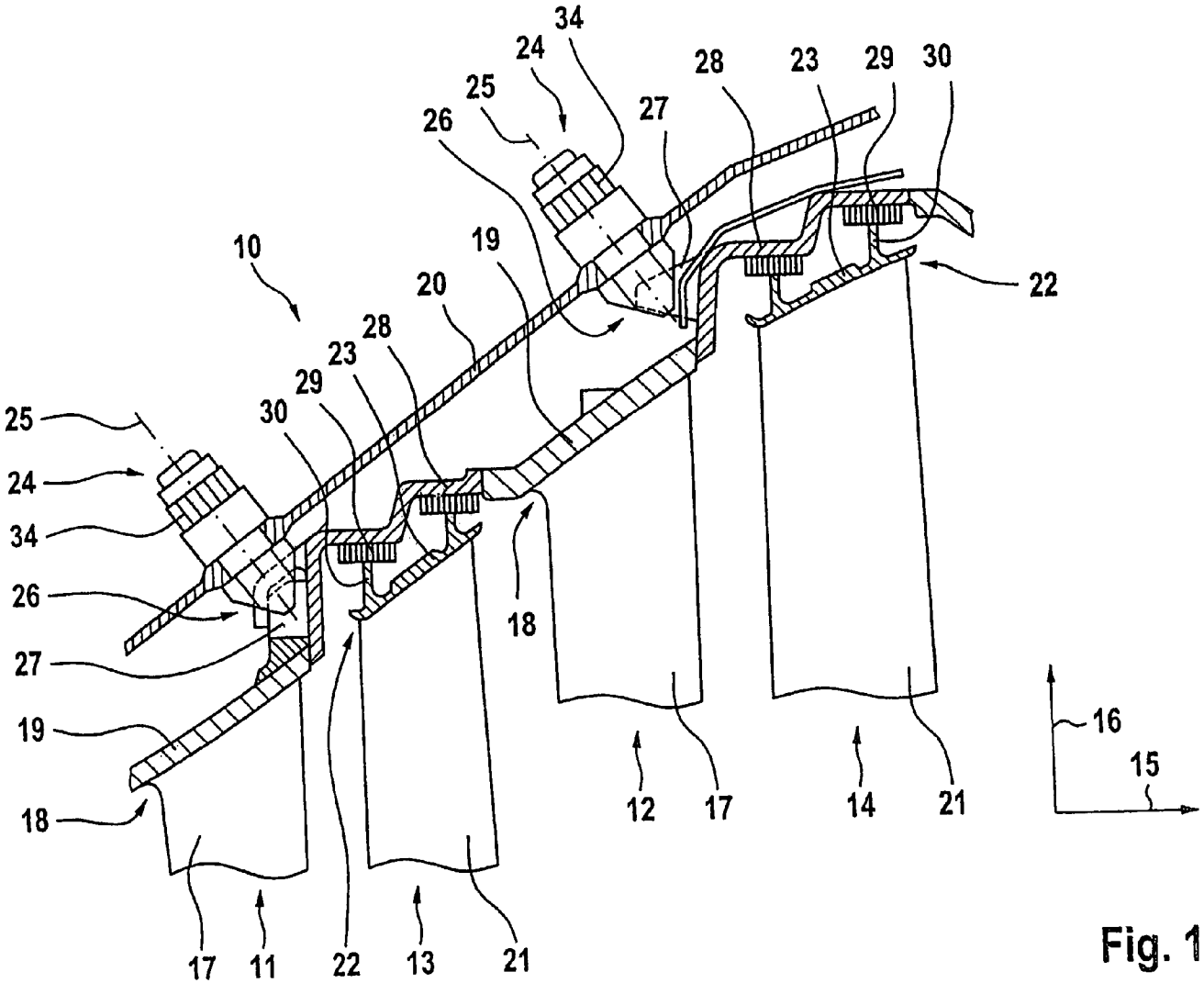
FIG. 1 a partial axial section through a gas turbine according to the invention.
Figure 2:
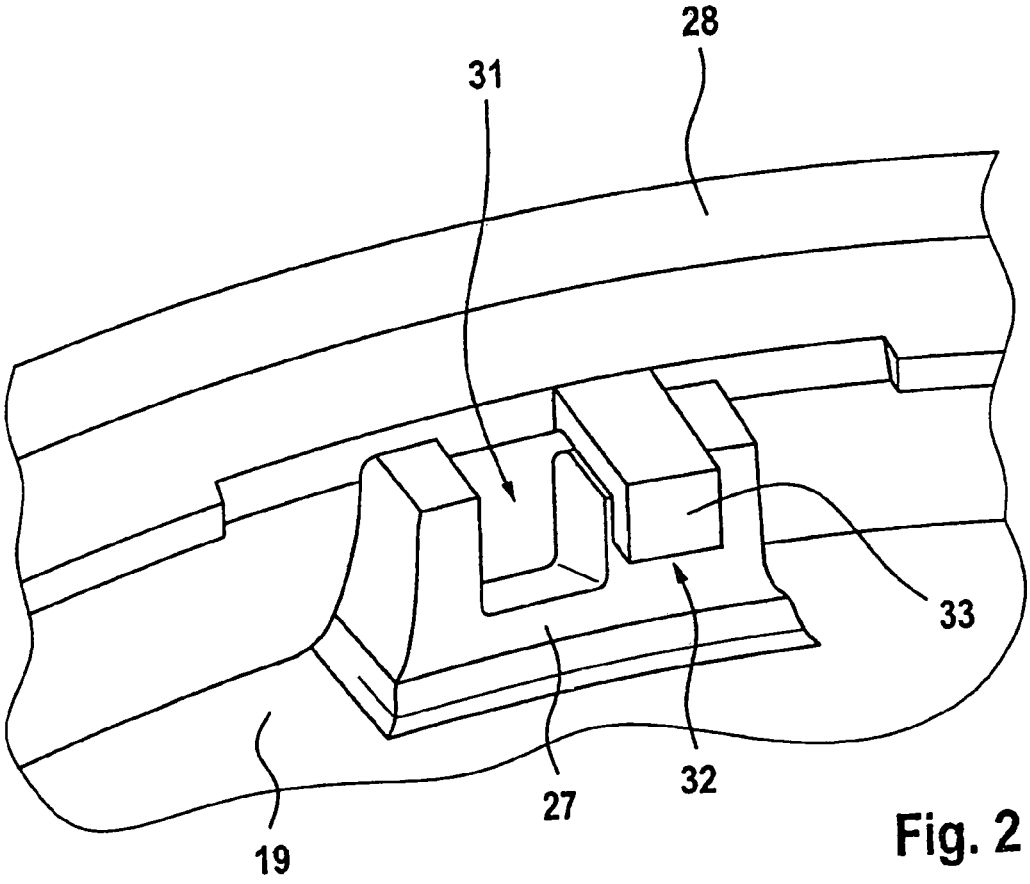
FIG. 2 is a substantially schematized detail of the arrangement of FIG. 1 in the area of an outer cover band or belt of a guide vane grid and an "outer air-seal" sealing in a perspective view.

FIG. 1 shows a section view of a low pressure turbine 10 in the area of two guide vane rings 11 and 12 as well as two rotor blade rings 13 and 14. The guide vane rings 11 and 12 and the rotor blade rings 13 and 14 are positioned in the axial direction of the low pressure turbine 10 alternately one behind the other. The axial direction of the low pressure turbine 10 is shown in FIG. 1 by an arrow 15, and the radial direction thereof is shown by an arrow 16.

Each of the guide vane rings 11 and 12 is formed by several guide vanes 17 arranged next to one another in the circumferential direction of the low pressure turbine 10. FIG. 1 only shows the radially outwardly positioned ends 18 of the guide vanes 17. So-called outer cover bands or belts 19 are provided in the area of the radially outwardly positioned ends 18 of the guide vanes 17. The guide vane rings 11 and 12 are allocated to a stator of the low pressure turbine 10 whereby the stator also comprises a housing 20 in addition to the guide vanes 17 of the guide vane rings 11 and 12. The housing 20 and the guide vane rings 11 and 12 are constructed to be stationary whereby the rotor blade rings 13 and 14 allocated to a rotor are rotating relative to the stationary guide vane rings 11 and 12 and relative to the stationary housing 20. Each of the rotating rotor blade rings 13 and 14 is thereby formed by several rotor blades 21 arranged next to one another in the circumferential direction of the low pressure turbine 10. Here again FIG. 1 only shows the radially outwardly positioned ends of the rotor blades 21. So-called outer cover belts 23 are provided in the area of the radially outwardly positioned ends 22 of the rotor blades 21.

In accordance with the present invention the centering and fixing of the guide vane rings 11 and 12 is accomplished by bearing journal pins or guide pins 24 which extend approximately perpendicularly to the housing 20. As can be seen in FIG. 1, a longitudinal central axis 25 of the guide pins 24 extends approximately perpendicularly to the housing 20 and thus extends at a slant to the radial direction (arrow 16) and to the axial direction (arrow 15) of the low pressure turbine 10. Ends 26 of the guide pins 24 reach into the housing 20 and thereby engage fork-shaped elements 27 for centering and fixing the guide vane rings 11 and 12. The fork-shaped elements 27 are allocated to the outer cover belts 19 of the guide vanes 11 and 12. Thereby several fork-shaped elements 27 are positioned distributed around the circumference of the outer cover belts of the guide vane rings 11 and 12. Thus, a respective guide pin 24 engages each of the fork-shaped elements 27 of a guide vane ring 11 or 12, whereby the guide pins 24, corresponding to the fork-shaped elements 27, are arranged and distributed around the circumference of the housing. For a spoke centering of a guide vane ring 11 or 12 at least three guide pins 24 are required to be distributed around the circumference of the low pressure turbine 10. These guide pins 24 cooperate with respective fork-shaped elements 27 in the area of the outer cover belts 19 of the guide vane rings 11 and 12. Preferably, seven such pairs of guide pins 24 and fork-shaped elements 27 are distributed and arranged about the circumference of the low pressure turbine 10 for each guide vane ring 11 and 12.

The fork-shaped elements 27 in the area of the outer cover belts 19 of the guide vane rings 11 and 12 are at least partially open in the radial direction and in the axial direction of the low pressure turbine 10 in order to make possible an engagement of the ends 26 of the guide pins 24, reaching into the housing 20, with the fork-shaped elements 27.

In accordance with the present invention the fork-shaped elements 27 of the guide vane rings 11 and 12 together with the guide pins 24 do not only cause a fixing and centering of the guide vane rings 11 and 12 in the housing but also cause a fixing and centering of seal carriers 28 which are arranged between neighboring outer cover belts 19 of neighboring guide vane rings 11 and 12. In the illustrated example embodiment the seal carriers 28 carry seal bodies 29 constructed as honeycomb seals which cooperate with so-called seal fins 30 positioned in the area of the outer cover belts 23 of the rotor blade rings 13 and 14, thereby sealing a gap between the radially outwardly positioned ends 22 of the rotor blades 21 and the housing 20 of the low pressure turbine 10.

The seal carriers 28 engage, just as the guide pins 24, in the fork-shaped elements 27 in the area of the outer cover belts 19 of the guide vane rings 11 and 12. This feature can particularly be seen in FIG. 2. FIG. 2 shows a fork-shaped element 27 in the area of an outer cover belt 19 of a guide vane ring as well as a portion of a seal carrier 28 which forms a so-called outer "air-seal" sealing. The fork-shaped element 27 comprises two recesses 31 and 32. The two recesses 31 and 32 are partially open in the radial direction as well as in the axial direction of the low pressure turbine 10 and are arranged next to one another in the circumferential direction of the same. The guide pins 24 engage with their ends 26 into a first recess 31. For reasons of a clear illustration, the ends 26 of the guide pins 24 are not shown in FIG. 2. A projection 33 of the seal carrier 28 engages in a second recess 32. Thus, it follows directly that not only a spoke centering of the guide vane rings 11 and 12 is achieved through the fork-shaped elements 27 and the guide pins 24 cooperating with the fork-shaped elements 27, but also a spoke centering of the seal carriers 28 of the so-called outer "air-seal" sealing is also achieved.

In order to limit a movability of the guide vane rings 11 and 12 in the axial direction of the low pressure turbine 10, at least one stop, not shown, is provided, whereby the stop or each stop is preferably integrated in one of the fork-shaped elements 27. With the stop or with each stop the axial movability of the guide vane rings 11 and 12 is limited to the required minimum.

The guide pins 24 or bearing journal pins are, as mentioned above, allocated to the housing 20 of the low pressure turbine 10 and reach with their free ends 26 into the interior of the low pressure turbine 10. For this purpose bores are integrated into the housing 20, whereby these bores extend perpendicularly to the housing 20. On the outside of the housing 20, nuts 34 are allocated to the guide pins 24. When the nuts 34 are loosened, the guide pins 24 can move within the bores of the housing 20. However, when the nuts 34 are tightened, the guide pins 24 particularly their free ends 26 are fixed in their position relative to the housing 20.

Figure 3:
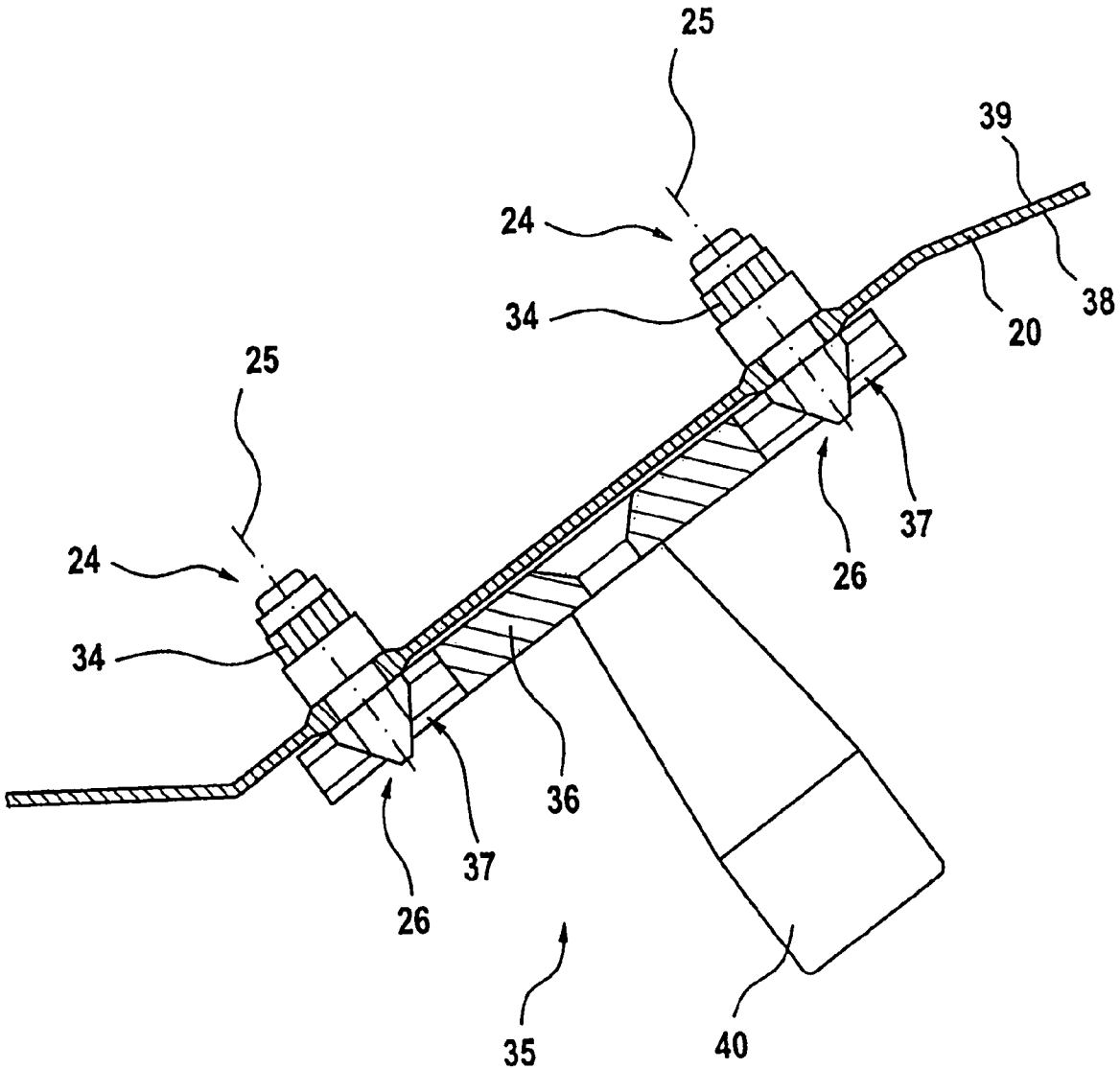
FIG. 3 shows a mounting device for the gas turbine according to the invention.

FIG. 3 shows a portion of the housing 20 of the low pressure turbine 10 together with two guide pins 24 and a mounting device 35 according to the invention. The mounting device 35 serves for aligning or adjusting the guide pins 24 or rather the free ends 26 of the guide pins 24 relative to the housing 20. An alignment or adjustment of the free ends 26 of the guide pins 24 is necessary in view of the following mounting or spoke centering of the guide vane rings 11 and 12 so that the free ends 26 of the guide pins 24 may be inserted in a precise position into the recesses 31 of the fork-shaped elements 27.

The mounting device 35 comprises a plate-shaped base body 36. At least two recesses 37 are integrated into the plate-shaped base body 36. The free ends 26 of the guide pins 26 are inserted into the recesses 37 of the plate-shaped base body 36 of the mounting device 35 for the alignment or adjustment. For this purpose, according to FIG. 3, on an inner side 38 of the housing 20, the plate-shaped base body 36 of the mounting device 35 is brought into such engagement with the free ends 26 of the guide pins 24 that the ends 26 pass through the base body 36 perpendicularly through a plane defined by the plate-shaped base body 36. The ends 26 are held against rotation in the recesses 37 of the plate-shaped base body 36.

In this position of the plate-shaped base body 36 on the inside 38 of the housing 20, the nuts 34 of the guide pins 24 can be tightened on the outside 39 of the housing 20. By tightening the nuts 34 it is assured that the alignment of the free ends 26 of the guide pins 24 cannot change itself.

Following the tightening of the nuts 34 and thus following the alignment and adjustment of the guide pins 24 or rather the free ends 26 thereof, the mounting device 35 can be brought out of engagement with the free ends 26 by moving the mounting device 35 tangentially to the plane defined by the plate-shaped base body 36, out of engagement with the free ends 26 of the guide pins. Thus, the mounting device 34 is moved in such a way that it is moved in the plane defined by the plate-shaped base body 36 whereby the free ends 26 are moved out of the recesses 37 within the plate-shaped base body 36. In order to make the handling of the mounting device 35 easier, it is provided with a handle 40 which extends approximately perpendicularly to the plate-shaped base body 36.

Although in the above example embodiment, the invention has been described with reference to an example of a low pressure turbine, it should be mentioned again that the invention can also be used in a compressor of a gas turbine. The invention is preferably used in aircraft engines.

The invention clamed is:

1. A turbomachine comprising:

a housing that includes at least a frustoconical sloping housing portion;

a rotor that includes rotor blades rotatably supported in a space within said sloping housing portion so as to be rotatable about an axis of said turbomachine;

a stator ring that includes stator guide vanes arranged in said space within said sloping housing portion axially adjacent to said rotor blades in an axial direction along said axis; and a spoke-centering arrangement that is arranged and adapted to adjustably support said stator ring relative to said housing and to spoke-center said stator ring about said axis;

wherein:

said spoke-centering arrangement comprises at least three guide pins distributed circumferentially, in a circumferential direction around said axis, about a circumference of said sloping housing portion, each respective one of said guide pins is secured to said sloping housing portion and respectively extends longitudinally at a slant relative to said axial direction and relative to a radial direction extending radially from said axis, through a respective through-hole in said sloping housing portion so that a respective free end of said respective guide pin protrudes inwardly into said space within said sloping housing portion, said spoke-centering arrangement further comprises at least three fork-shaped elements distributed circumferentially in said circumferential direction about a circumference of said stator ring, each respective one of said fork-shaped elements is connected to said stator ring and respectively defines at least a first slot recess between a pair of fork walls of said respective fork-shaped element, said first slot recess of each respective one of said fork-shaped elements is at least partly open in said radial direction and in said axial direction, and is bounded between said pair of said fork walls in said circumferential direction, said free end of each said respective one of said guide pins respectively engages into said first slot recess of a respective associated one of said fork-shaped elements while being constrained in said circumferential direction between said pair of said fork walls of said respective associated fork-shaped element and allowing at least a limited relative motion between said respective guide pin and said respective associated fork-shaped element in said radial direction and in said axial direction in which said first slot recess of said respective associated fork-shaped element is at least partly open.

2. The turbomachine according to claim 1, wherein said spoke-centering arrangement comprises exactly seven of said guide pins and correspondingly exactly seven of said fork-shaped elements respectively distributed about said circumference on a radial plane.

3. The turbomachine according to claim 1, wherein said free end of each respective one of said guide pins respectively has a triangular shape as seen in said circumferential direction, with an apex of said triangular shape pointing inwardly into said space within said sloping housing portion along a longitudinal axis of said respective guide pin extending at said slant relative to said axial direction and relative to said radial direction, and wherein said triangular shape lies on a plane extending in said axial direction, and wherein said free end of said respective guide pin is elongated on said plane and parallel to said sloping housing portion.

4. The turbomachine according to claim 1, wherein said spoke-centering arrangement includes nuts that respectively adjustably secure said guide pins on an outer side of said sloping housing portion.

5. The turbomachine according to claim 1, wherein said spoke-centering arrangement further includes a stop arranged on one of said fork-shaped elements so as to bound and limit an axial movability of said one of said fork-shaped elements and said guide vane ring connected thereto, relative to one of said guide pins that engages with said free end thereof into said one of said fork-shaped elements.

6. The turbomachine according to claim 1, wherein said stator ring further includes an outer cover band extending in said circumferential direction and connected to radially outer ends of said stator guide vanes, and wherein said fork-shaped elements are connected to said outer cover band.

7. The turbomachine according to claim 1, further comprising a seal carrier arranged axially adjacent to a radially outer portion of said stator ring.

8. The turbomachine according to claim 7, wherein said stator ring includes an outer cover band that forms said outer portion of said stator ring, and that extends in said circumferential direction, and that is connected to radially outer ends of said stator guide vanes, further comprising a seal body carried on a radially inward side of said seal carrier, and wherein radially outer ends of said rotor blades sealingly cooperate with said seal body.

9. The turbomachine according to claim 7, wherein said seal carrier engages with said guide pins and/or said fork-shaped elements so that said seal carrier is spoke-centered about said axis by said spoke-centering arrangement.

10. The turbomachine according to claim 7, wherein each said fork-shaped element respectively further defines a second slot recess between another pairing of fork walls of said fork-shaped element, said seal carrier includes a projection protruding from a seal carrier member, and said projection is engaged into said second slot recess.

11. The turbomachine according to claim 10, wherein said first slot recess and said second slot recess of said fork-shaped element are positioned circumferentially next to one another with one of said fork walls therebetween in said circumferential direction.

12. The turbomachine according to claim 1, wherein said turbomachine is a turbo-engine.

13. The turbomachine according to claim 1, wherein said turbomachine is a gas turbine.

14. The turbomachine according to claim 1, wherein said guide pins respectively extend longitudinally substantially perpendicularly to said sloping housing portion.

15. The turbomachine according to claim 1, wherein said spoke-centering arrangement includes a first set of said guide pins distributed circumferentially about said circumference of said sloping housing portion on a first plane normal to said axis, a second set of said guide pins distributed circumferentially about said circumference of said sloping housing portion on a second plane normal to said axis and spaced axially from said first plane, a first set of said fork-shaped elements distributed circumferentially about said circumference of said stator ring on said first plane so as to engage respectively with said first set of said guide pins, and a second set of said fork-shaped elements distributed circumferentially about said circumference of said stator ring on said second plane so as to engage respectively with said second set of said guide pins.

16. A combination of the turbomachine according to claim 15 and a mounting tool adapted to carry out an alignment or adjustment of a selected first one of said guide pins of said first set and a selected second one of said guide pins of said second set, wherein said mounting tool comprises a plate-shaped base body having two recesses therein, wherein said plate-shaped base body is positioned on a radially inner side of said sloping housing portion with said respective free ends of said first and second selected guide pins respectively received in said two recesses of said plate-shaped base body so that said first and second selected guide pins are thereby held in an aligned and adjusted position and constrained against turning, and further comprising two nuts respectively tightened onto said first and second selected guide pins on an outer side of said sloping housing portion.

17. The combination according to claim 16, wherein said mounting tool further comprises a handle extending approximately perpendicularly from said plate-shaped base body.

18. The combination according to claim 16, wherein said two recesses of said plate-shaped base body are so configured and arranged such that said respective free ends of said first and second selected guide pins extend longitudinally perpendicularly to a plane along which said plate-shaped base body extends, and such that said plate-shaped base body can be disengaged and removed from said free ends of said first and second selected guide pins tangentially to said plane.

* * * * *